US009227741B2

(12) United States Patent
Oztas et al.

(10) Patent No.: US 9,227,741 B2
(45) Date of Patent: Jan. 5, 2016

(54) EQUIPMENT FOR PRODUCING COOLING PACKS CONSISTING OF A SHELL MADE OF A POROUS MATERIAL CONTAINING AN AMOUNT OF CARBON-DIOXIDE SNOW ENCLOSED AND RETAINED INSIDE THE CASING

(75) Inventors: Cemal Oztas, Cankaya/Ankara (TR); Dominique Robillard, Versailles (FR); Jo Algoet, Wijtschate-Heuvelland (BE)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 425 days.

(21) Appl. No.: 13/880,612

(22) PCT Filed: Aug. 10, 2011

(86) PCT No.: PCT/FR2011/051894

§ 371 (c)(1),
(2), (4) Date: Apr. 19, 2013

(87) PCT Pub. No.: WO2012/052638

PCT Pub. Date: Apr. 26, 2012

(65) Prior Publication Data

US 2013/0206282 A1 Aug. 15, 2013

(30) Foreign Application Priority Data

Oct. 21, 2010 (FR) ..... 10 04124

(51) Int. Cl.
*B65B 1/04* (2006.01)
*F25D 3/12* (2006.01)

(52) U.S. Cl.
CPC .. *B65B 1/04* (2013.01); *F25D 3/125* (2013.01)

(58) Field of Classification Search
CPC ..... F25D 3/12; F25D 3/125; F25D 2303/082; B65B 1/04
USPC ..... 141/114, 237, 244, 302, 313–317; 62/530, 603, 344
See application file for complete search history.

(56) References Cited

U.S. PATENT DOCUMENTS 3,063,258 A * 11/1962 Szachnitowski ..... 62/309
5,715,685 A * 2/1998 Takasugi ..... 62/52.1

(Continued)

FOREIGN PATENT DOCUMENTS

EP 0 717 246 6/1996
EP 0 823 600 2/1998

(Continued)

OTHER PUBLICATIONS

International Search Report for PCT/FR2011/051894, mailed Oct. 10, 2011.

(Continued)

*Primary Examiner* — Timothy L Maust
*Assistant Examiner* — Timothy P Kelly
(74) *Attorney, Agent, or Firm* — Christopher J. Cronin

(57) ABSTRACT

The invention relates to equipment for producing cool packs containing an amount of carbon-dioxide snow, which includes: a set of at least two cells, each of which is capable of receiving and supporting a shell to be filled; a feeding tube connected, at the upstream portion thereof, to a liquid CO2 source; a set of at least two injection manifolds, each injection manifold being located opposite a cell in which a casing to be filled is to be positioned, and each manifold being connected, at the upstream portion thereof, to the feeding tube, wherein each manifold comprises an injection port at at least one location along the length thereof, the equipment being characterized in that: i) the end of each manifold opposite the feeding tube is formed as a sealed end provided in the form of a substantially rounded tip; j) each injection port located on a manifold is a provided as a threaded opening having a given diameter D and is capable of receiving an injection nozzle by means of screwing; k) said equipment comprises at least two injection nozzles, each injection nozzle being provided in the form of a part that is cylindrical over at least a portion of the length thereof, said cylinder being a hollow cylinder, the threaded outer diameter of which is equal to the diameter D of at least one of the threaded openings of at least one of the manifolds, and the inner diameter d of which is less than D.

9 Claims, 2 Drawing Sheets

(56) References Cited

U.S. PATENT DOCUMENTS

| | | | | |
|---|---|---|---|---|
| 2002/0029584 | A1* | 3/2002 | Gibot et al. | 62/530 |
| 2009/0266031 | A1* | 10/2009 | Flamant et al. | 53/436 |

FOREIGN PATENT DOCUMENTS

| | | |
|---|---|---|
| EP | 0 990 836 | 4/2000 |
| EP | 1 090 259 | 4/2001 |
| EP | 1 186 842 | 3/2002 |
| FR | 2 604 243 | 3/1988 |
| WO | WO 99 67585 | 12/1999 |

OTHER PUBLICATIONS

French Search Report for FR 1 004 124, mailed Apr. 15, 2011.

* cited by examiner

EQUIPMENT FOR PRODUCING COOLING PACKS CONSISTING OF A SHELL MADE OF A POROUS MATERIAL CONTAINING AN AMOUNT OF CARBON-DIOXIDE SNOW ENCLOSED AND RETAINED INSIDE THE CASING

CROSS-REFERENCE TO RELATED APPLICATIONS

This application is a §371 of International PCT Application PCT/FR2011/051894, filed Aug. 10, 2011, which claims §119(a) foreign priority to French patent application 1004124, filed Oct. 21, 2010.

BACKGROUND

1. Field of the Invention

The present invention relates to the field of devices for packaging carbon dioxide snow inside a plastic film.

2. Related Art

It is known that frozen, deep-frozen or even fresh products, notably foodstuffs, which have to be kept at a controlled temperature of +2° C. to −20° C., or even less, with no break in their cold chain from the time that they are cooled, frozen or deep-frozen to the time of their use, require warehouses, means of transport and stores which are fitted with refrigeration installations, which at the present day are generally electric. However, in many cases, it is impossible to transport the products without removing them from the refrigeration installation in which they are being stored, and the risks of a rise in temperature are then great, particularly if the climatic conditions are unfavorable. In order to avoid such a rise in temperature during their transport, it is common practice for such products to be placed in an environment that is kept at a controlled temperature in an isothermal chamber. Temperature regulation is ensured for example by slow sublimation of carbon dioxide snow packaged in bags made of perforated plastic film. Carbon dioxide snow is a relatively inexpensive product which has an attractive refrigeration value: 573 kJ/kg of snow. Its temperature of around −80° C. ensures that the products can be kept cold for relatively lengthy periods.

By way of illustration, reference may be made to document EP-1 186 842 which describes a device for automatically and continuously packaging carbon dioxide snow in a plastic film.

Reference may also be made to documents FR-2 604 243 or EP-823 600, or even to U.S. Pat. No. 5,271,233 which describe cooling blocks containing a mass of carbon dioxide snow.

Reference may also be made to document EP-1 090 259, which describes a method and an installation for obtaining cooling blocks made up of a wrapper made of a porous material (capable of withstanding low temperatures of below 1° C.) containing a mass of carbon dioxide snow enclosed and contained in the wrapper, the wrapper being made of a material which, as this document indicates, has a "porosity to air of between 100 and 500 $m^3/m^2/mn$ for an air pressure of the order of 196 Pa", for example made of a nonwoven polypropylene.

A manual bagging machine is therefore a piece of equipment which, using a source of liquid $CO_2$, can be used, by expansion, to generate carbon dioxide snow directly in bags made of a porous material (generally woven polypropylene). The amount of snow can be adapted according to the injection time used, and according to the supply pressure of the liquid $CO_2$. The equipment available on the market generally seeks to be able to fill several bags simultaneously.

The injectors installed on the manual bagging machines available are usually formed of perforated tubes.

By way of example, as schematically illustrated in the attached FIG. 1 which relates to the prior art, a feed tube, connected at its upstream part to a source of liquid $CO_2$, feeds a set of injection pipes, each facing a cell in which a bag that is to be filled will be positioned, and each connected at its upstream part to an electrically operated valve (directly or alternatively via primary tubes to which they are welded).

Each injection pipe has an injection orifice machined along its length, and it will therefore be appreciated that, in order to change the injection delivery rate, it was necessary to remove one or more of the injection pipes and modify (remachine) the injection orifice, something which represents a complicated exercise offering little flexibility.

This configuration of the prior art did, on the other hand, ensure perfect rigidity, something which is needed for comfortably introducing the bags and for removing the bags.

SUMMARY OF THE INVENTION

One of the objectives of the present invention is therefore to propose a new installation making it possible to improve this matter of flexibility and notably to achieve greater ease with which the delivery orifices can be varied to suit the needs of a user site (the site where the bags are filled) to vary the delivery output.

As will be seen in greater detail in what follows, the installation proposed by the present invention is essentially characterized in that it comprises:

- a set of at least two cells, each able to accommodate and to hold a wrapper that is to be filled;
- a feed tube, connected at its upstream part to a source of liquid $CO_2$,
- a set of at least two injection pipes, each situated facing a cell in which a bag that is to be filled will be positioned, and each being connected at its upstream part to the feed tube (preferably via an electrically operated valve, one electrically operated valve for each injection pipe, it being possible for the electrically operated valve to be connected directly or alternatively via an intermediate tube (referred to as a primary tube) to which the injection pipe is mechanically secured (for example by welding).
- each injection pipe comprises at one location along its length, at least one injection orifice,
- the end of each injection pipe, the opposite end to the feed tube, takes the form of a blanked-off end, in the form of a substantially rounded tip;
- each injection orifice present on each injection pipe takes the form of a threaded orifice of diameter D, into which an injection nozzle can be screwed;
- each injection nozzle takes the form of an at least partially cylindrical shape (over at least a portion of its length) that is hollow, a hollow cylinder the (threaded) outside diameter of which is equal to said diameter D (and therefore compatible with the injection orifice in the injection pipe to which the nozzle in question is to be fixed), and the inside diameter d of which is, as will be appreciated, smaller than D.

It will have been appreciated from reading the foregoing that:

- the rounded tip makes it easier to insert the injection pipe into a bag that is to be filled;
- the injection nozzles have a diameter D compatible with that of an injection orifice of one of the injection pipes of the installation, whereas a whole array of injection nozzles with high varying inside diameter d can be made available for a given D, allowing the injection delivery rate to be varied easily according to the requirements of the user site, it being sufficient in order to do so to unscrew a given nozzle, of given inside diameter $d_1$, to change to a nozzle of different diameter $d_2$, smaller or larger, the change being immediate, without major intervention and, best of all, without remachining.

According to a preferred implementation of the invention, each injection pipe of the installation comprises just one threaded injection orifice at a point along its length, but it is of course possible, without in any way departing from the scope of the invention, to conceive of having, on one or more of the injection pipes of the installation, several threaded injection orifices on the injection pipe or pipes concerned.

Indeed the configuration in which there is just one orifice for each of the injection pipes is actually preferred in order to minimize the risks of blockage by the formation of snow, achieving this by maintaining a perfect "continuity of fluid" between the $CO_2$ source and the one single orifice of each injection pipe, although other situations and operating conditions could justify the presence of one or more injection pipes with several orifices without leading to the risk of blockage, for example in order to cope with high delivery throughputs.

According to a preferred implementation of the invention, all the injection pipes of the installation are equipped with an orifice (or, where appropriate, with several), the diameter D being the same for all the orifices of the injection pipes.

However, here too it is possible, without in any way departing from the scope of the invention, to conceive that one or more of the injection pipes of the installation might have an orifice not of threaded diameter D but of threaded diameter D', larger than or smaller than D, which would make it easier to adapt to the varying needs of the user site.

By way of illustration, according to one of the implementations of the invention, all the threaded orifices of the installation have a diameter D=8 mm, and the screw-in nozzles have an inside diameter d=4 mm or 3 mm for example.

However, according to another embodiment of the invention, one or more of the injection pipes of the installation are equipped with a threaded injection orifice the diameter of which is 8 mm, whereas one or more of the injection pipes of the installation are equipped with a threaded injection orifice the diameter of which is not 8 mm but 10 mm, which allows nozzles of inside diameter of 5 or 6 mm to be fitted (screwed into) them.

According to one advantageous embodiment of the invention, the screw-in injection nozzles take the form of a hollow cylindrical body over just part of their length, whereas over the rest of the nozzle (the part opposite the part of the nozzle that fits into the injection orifice corresponding to it) they adopt a conically flared shape, which flared bottom part can then be smooth (plain) or otherwise on the outside, the advantage of this arrangement being that it limits the risks of the nozzle being screwed fully home into the threaded injection orifice which would then present difficulties with extracting the nozzle when the time comes to change it.

The present invention therefore relates to an installation for obtaining cooling blocks made up of a wrapper made of a porous material, containing a mass of carbon dioxide snow enclosed and retained in the wrapper, the installation comprising:

a set of at least two cells, each able to accommodate and to hold a wrapper that is to be filled;

a feed tube, connected at its upstream part to a source of liquid $CO_2$, a set of at least two injection pipes, each injection pipe being situated facing a cell in which a wrapper that is to be filled will be positioned, and each injection pipe being connected at its upstream part to the feed tube, preferably via an electrically operated valve, directly or alternatively via an intermediate tube to which the injection pipe is mechanically secured, each injection pipe comprising, at least at one location along its length, an injection orifice, the installation being characterized in that:

i) the end of each injection pipe, the opposite end to the electrically operated valve, takes the form of a blanked-off end, in the form of a substantially rounded tip;

j) each injection orifice present on an injection pipe takes the form of a threaded orifice of given diameter D, into which an injection nozzle can be screwed;

k) each injection nozzle takes the form of a component that is cylindrical over at least part of its length, a hollow cylinder the threaded outside diameter of which is equal to the diameter D of at least one of the threaded orifices of at least one of the injection pipes, and the inside diameter d of which is smaller than D.

BRIEF DESCRIPTION OF THE FIGURES

Other features and advantages of the present invention will become more clearly apparent from the following description, given by way of entirely nonlimiting illustration, given with reference to the attached drawings in which.

DETAILED DESCRIPTION OF THE INVENTION

Figure 1:
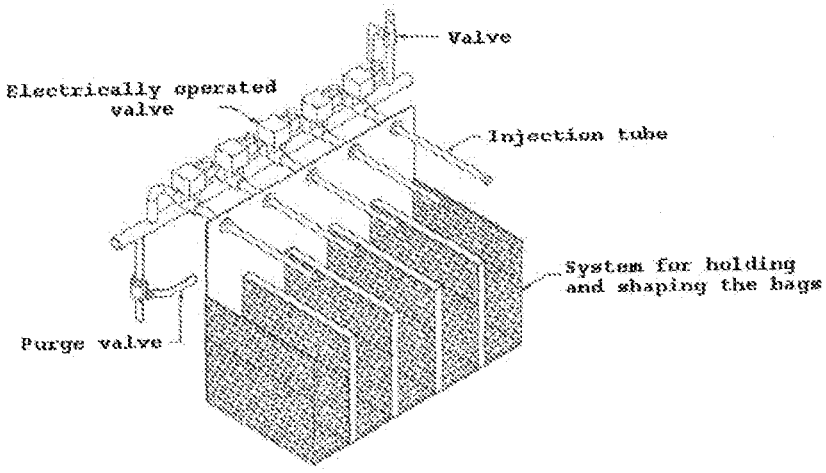
FIG. 1 is a schematic depiction of a multi-bag bagging machine according to the prior art, fitted with injection pipes in each bag (bagging machine already described hereinabove).
Figure 2:
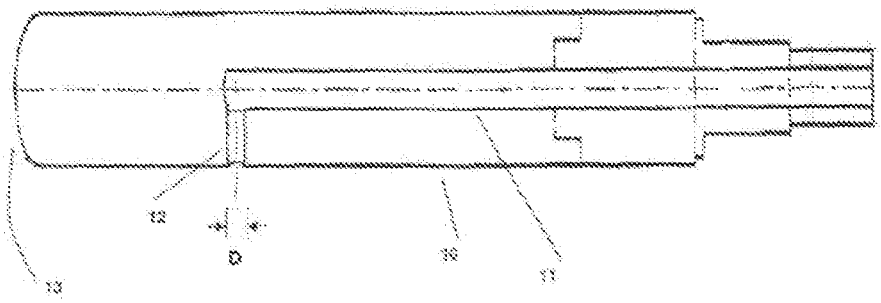
FIG. 2 is a schematic depiction of an injection pipe according to the invention, that can be fitted to the installation of FIG. 1.

FIG. 2 is a schematic depiction in cross section of one embodiment of an injection pipe 10 according to the invention, that can be fitted to the installation of FIG. 1:

its blanked-off tip 13 is of substantially rounded shape;

the presence, at a location along the injection pipe (here, 85 mm from the rounded tip) of a single threaded orifice 12 of given diameter D (for example 8 mm), into which an injection nozzle can be screwed.

this orifice 12 is in fluidic communication (internal duct 11) with the electrically operated valve which corresponds to this injection pipe and to which it is secured (the electrically operated valve has not been depicted here for the sake of clarity) for example by welding to an intermediate portion of ducting between the injection pipe 10 and the electrically operated valve.

According to one embodiment of the invention, all the injection pipes of the bagging machine are as per the injection pipe of FIG. 2 (i.e. have just one orifice per injection pipe, all the orifices of the injection pipes have the same threaded diameter D).

Figure 3:
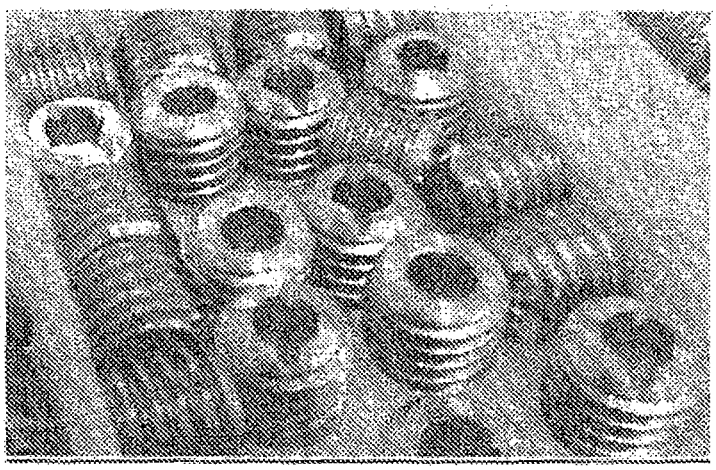
FIG. 3 illustrates a set of injection nozzles according to the invention, with threaded outside diameter D, and with varying inside diameter d (which is smaller than D).

FIG. 3 precisely gives a better view of a set of injection nozzles according to the invention, that can be screwed into the injection orifices of the injection pipes of the bagging machine, these nozzles having a threaded outside diameter D (here 8 mm) and a varying inside diameter d (for example 4 mm, 3 mm, 2 mm or, for example, in increments of 0.1 mm . . . ), that can be screwed into the orifice 12 of each injection pipe easily and immediately.

Should it prove necessary, to meet the needs of the user site, to change the injection delivery rate, then all that is required is a change of nozzle, from within the set of nozzles depicted here, and therefore the diameter injecting into the bag, and this can be done immediately, without major intervention, without welding, etc., and can be done for just one or for several of the injection pipes of the bagging machine.

It may be pointed out that having available a set of nozzles in 0.1 or 0.2 mm size increments is highly advantageous because this configuration makes producing the same quantity of snow for each injection pipe easier (the discrepancies are linked to the pressure drops between the first injection pipe to be fed and those that follow), this being done by very finely adjusting the inside diameter of the nozzles connected from one injection pipe to another (this will be illustrated further on in the present application).

Figure 4:
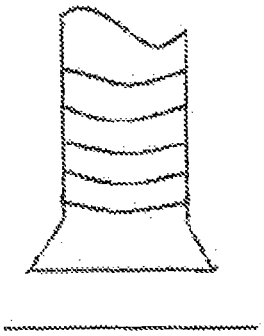
FIG. 4 schematically and partially in cross section illustrates an example of injection nozzle which has a hollow cylindrical body over just part of its length, whereas over the rest of the nozzle (the part of the nozzle opposite the part of the nozzle that is intended to enter the injection orifice corresponding to it) it adopts a conically flared shape.

If the screw-in injection nozzles of FIG. 3 take the form of a hollow cylindrical body over their entire length, as mentioned earlier on, it will be preferable to have available nozzles which over part of their length have this hollow cylindrical shape but which flare towards the bottom over the remainder of the nozzle, which flared bottom part may be smooth (plain) or otherwise, the purpose of this arrangement being to limit the risks of the nozzle being screwed fully home into the threaded orifice which would then present difficulties with extracting the nozzle when the time comes to change it (FIG. 4 below).

The invention is illustrated hereinbelow via practical examples of how the invention is used, obtained under the operating conditions detailed hereinafter.

Use was made of an installation of the type of that of FIG. 1, with five injection pipes, each injection pipe being in accordance with FIG. 2:

- diameter D=8 mm
- rounded hemispherical end of diameter 20 mm
- diameter of duct 11=5 mm
- The protocol observed was as follows:
- sequence:
  - installation pressurized and purged with gas (to clean out the piping)
  - cooling
  - dummy run (without bag)
  - adjustment of nozzles d (diameter)
  - adjustment of injection time
  - injection
  - weighing
  - repeat of tests
- parameters tested
  - operation: absence of blockage
  - repeatability of tests
  - influence of injection time Based on a given injection time (50 s), the nozzles are adjusted in order to determine the optimum configuration for obtaining the most uniform possible quantity of snow across the 5 bags.

The following conclusions can be drawn:

- excellent repeatability was found in the results obtained in the follow setup during the course of repeated testing:
  - upstream pressure: 17 to 20 bar
  - inside diameter d of the five nozzles screwed into the orifice D of each of the 5 injection pipes: 3.6 mm, 3.6 mm, 3.5 mm, 3.7 mm and 3.7 mm respectively:
  - mass of snow loaded into each bag in the 50 seconds of injection: 3780 g, 3800 g, 3890 g, 3830 g and 3720 g respectively, representing a deviation of ±2% about the mean, which is remarkable (snow delivery rate: around 4.6 kg/mn);
- it was also possible to draw graphs (for a given nozzle adjustment d adopted as being optimal in terms of consistency across bags, as described hereinabove) of the quantity of snow loaded as a function of injection time (for example in increments of 5 to 10 seconds between a time of 20 seconds and an injection time of 50 seconds) that yielded a straight line, the characteristics of the straight line being perfectly repeatable during the course of repeated testing, this representing an extremely simple and practical tool for making an operator's task easier later;
- it will have been understood, without there being any need to place further emphasis here, that all of these tests with screw-in nozzles changed at will were also easy to carry out merely thanks to the structure of the machine according to the invention (injection pipes, "D" orifices, "d" screw-in nozzles, etc.), and that the same will be true of the daily task of an operator on such a machine according to the invention.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a non-exclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. An installation for obtaining cooling blocks made up of a wrapper made of a porous material that contains, encloses and retains, within the wrapper, a mass of carbon dioxide snow, said installation comprising:

a set of at least two cells, each able to accommodate and to hold a wrapper that is to be filled with carbon dioxide snow;

a source of liquid $CO_2$;

a feed tube, connected at its upstream part to the source of liquid $CO_2$;

a set of at least two injection pipes, each injection pipe being situated facing a respective cell in which a wrapper that is to be filled will be positioned, an upstream part of each injection pipe being fluidly connected to the feed tube, downstream ends of the injection pipes are formed as substantially rounded tips, each injection pipe comprising, at least at one location along its length, a threaded injection orifice and;

a set of at least two injection nozzles each injection nozzle is formed as a hollow cylinder over at least part of its length with an inner diameter that is smaller than an inner diameter of the threaded injection orifice into which it is threadedly inserted.

2. The installation of claim 1, wherein each of the injection pipes of the installation is equipped with just one threaded injection orifice.

3. The installation of claim 1, wherein one or more of the injection pipes of the installation are equipped with more than one threaded injection orifice.

4. The installation of claim 1, wherein the inner diameter of each threaded injection orifice is the same.

5. The installation of claim 1, wherein the inner diameters of the threaded orifices are not always the same.

6. The installation of claim 1, wherein each of the injection nozzles is formed as a hollow cylinder over its entire length.

7. The installation of claim 1, wherein each of the downstream ends of the injection nozzles has a conically flared shape.

8. The installation of claim 1, wherein the upstream part of each injection pipe is fluidly directly connected to the feed tube via an electrically operated valve.

9. The installation of claim 1, wherein the upstream part of each injection pipe is fluidly connected to the feed tube via an intermediate tube to which the injection pipe is mechanically secured.

* * * * *